US006221212B1

(12) United States Patent
Sjöström

(10) Patent No.: US 6,221,212 B1
(45) Date of Patent: Apr. 24, 2001

(54) CARDBOARD HAVING GREAT REIGIDITY

(75) Inventor: Håkan Sjöström, Örebro (SE)

(73) Assignee: Stora Kopparbergs Bergslags AB, Falun (SE)

( * ) Notice: Subject to any disclaimer, the term of this patent is extended or adjusted under 35 U.S.C. 154(b) by 0 days.

(21) Appl. No.: 09/474,364

(22) Filed: Dec. 29, 1999

Related U.S. Application Data

(63) Continuation of application No. PCT/SE98/01321, filed on Jul. 6, 1998.

(30) Foreign Application Priority Data

Jul. 7, 1997 (SE) ..... 9702613

(51) Int. Cl.[7] ..... D21H 27/10

(52) U.S. Cl. ..... 162/125; 162/127; 162/129; 162/130; 162/141; 162/142; 162/149; 162/135

(58) Field of Search ..... 162/123, 125, 162/127, 129, 130, 142, 135, 141, 149

(56) References Cited

U.S. PATENT DOCUMENTS

| | | | | |
|---|---|---|---|---|
| 4,145,246 | * | 3/1979 | Goheen et al. | 162/142 |
| 4,718,982 | * | 1/1988 | Swenson et al. | 162/142 |
| 4,836,892 | * | 6/1989 | Edwards et al. | 162/142 |
| 4,913,773 | | 4/1990 | Knudsen et al. . | |
| 5,147,505 | | 9/1992 | Altman . | |
| 5,169,496 | * | 12/1992 | Wagle et al. | 162/129 |
| 5,244,541 | * | 9/1993 | Minton | 162/129 |
| 5,916,417 | * | 6/1999 | Cassidy et al. | 162/130 |

FOREIGN PATENT DOCUMENTS

| | | |
|---|---|---|
| 1251718 | 3/1989 | (CA) . |
| 23 60 295 | 10/1976 | (DE) . |
| 0511185A1 | 10/1992 | (EP) . |
| 1405006 | 9/1975 | (GB) . |
| WO95/26441 | 10/1995 | (WO) . |

* cited by examiner

*Primary Examiner*—Peter Chin
(74) *Attorney, Agent, or Firm*—Burns, Doane, Swecker & Mathis LLP

(57) ABSTRACT

A cardboard with great rigidity and low grammage, as well as a package made thereof, is described. The cardboard consists of a core, which is surrounded by at least one, preferably 1–3 outer plies, on each side. The cardboard has a grammage of 100–300 g/m$^2$, a bending resistance index of at least 25 Nm$^6$/kg$^3$, and a Scott Bond z-strength of at least 100 J/m$^2$. The core of the cardboard consists of chemi-thermomechanical pulp and has a density of 200–450 kg/m$^3$ and the core constitutes 55–80% of the total grammage of the cardboard. The outer plies have a tensile stiffness index of 7.0–9.5 kgNm/g and mainly consist of chemical pulp.

20 Claims, No Drawings

CARDBOARD HAVING GREAT REIGIDITY

This is a continuation of International Application No. PCT/SE98/01321, filed Jul. 6, 1998, that designates the United States of America and which claims priority from Swedish Application No. 9702613-2, filed Jul. 7, 1997.

FIELD OF THE INVENTION

The present invention relates to a cardboard having great rigidity and a package made thereof.

More specifically, the present invention relates to a cardboard, which has great rigidity and low grammage, at the same time as the other qualities of the cardboard, in particular its z-strength (internal bond strength), are at a satisfactory level.

BACKGROUND OF THE INVENTION

Rigidity is the most important functional quality of cardboard. The rigidity is particularly important to cardboard used for packages to make them easy to grip. The rigidity is expressed by the bending resistance or by the bending resistance index of the cardboard. The rigidity of cardboard is primarily adjusted by means of its grammage, higher grammage resulting in greater rigidity. In the case of identical grammage, the rigidity of the cardboard is determined by several parameters, principally its thickness and its tensile stiffness index, which is tensile stiffness/grammage. Great thickness is very important to rigid cardboard. A common value of the rigidity of cardboard for liquid cartons is a bending resistance index of about 20 $Nm^6/kg^3$ or lower.

The grammage, which according to that stated above is related to the rigidity, is another important quality of cardboard. A low grammage implies little consumption of material, and therefore this is desirable from an economic point of view. A common value of the grammage of cardboard for 2-litre beverage cartons is about 360 $g/m^2$.

In addition to rigidity and grammage, cardboard should in most cases satisfy other requirements as well. Thus, many converting operations require a certain degree of z-strength of the cardboard. The convertibility implies that the cardboard can be creased, punched and, for instance, covered with a plastic coating. In this connection, the z-strength is important to avoid undesired delamination of the cardboard, for instance when covering it with a plastic coating. if the cardboard has too little z-strength, the cooling roll adheres to the plastic during the extrusion coating and the cardboard is delaminated when being removed from the cooling roll. A satisfactory degree of z-strength is also necessary to obtain a good runnability, e.g. when splicing rolls, so-called flying splice. For a cardboard to be considered to satisfy the requirements of convertibility, it should have a z-strength of at least about 100 $J/m^2$, and preferably of at least about 120 $J/m^2$. A common value for cardboard is about 180 $J/m^2$ or higher. The z-strength is usually adjusted by beating, increased beating resulting in a higher degree of fibre bonding and greater z-strength. However, at the same time the density increases and both thickness and rigidity decrease.

In addition to rigidity, printability is important. Qualities conditioning printability are brightness, measured as ISO brightness, whiteness and roughness, measured e.g. as a Bendtsen roughness number. In general, the ISO brightness should be at least about 72%, and the Bendtsen roughness should be about 800 ml/min at the most. A greater roughness of the cardboard can be tolerated if print is applied on the plastic coating or if the cardboard is laminated with a preprinted plastic film.

It is apparent from that stated above that several qualities as mentioned are in opposition to each other, an improvement of one quality at the same time leading to a deterioration of another quality. Thus, it is understood that it is very difficult to simultaneously obtain in cardboard the maximal values strived for of all the qualities mentioned above, in particular the values of rigidity, grammage and z-strength.

The following references are examples of prior-art techniques within this field.

From the Canadian patent specification 1,251,718, a multi-layer paper board is known, in which the central layer has a high density of about 550–770 $kg/m^3$. The central layer consists of 30–70% chemically modified thermomechanical pulp (CTMP) and the rest of long fibre sulphate pulp to obtain a sufficient z-strength.

From U.S. Pat. No. 5,244,541, it is known to increase the z-strength and decrease the density by treating fibres of mechanical pulp mechanically and bending them. This additional mechanical treatment demands, however, a great deal of energy, and moreover bent fibres normally yield a more flocculant sheet, that is an inferior formation. Further, bent fibres deteriorate the tensile stiffness as well as the compression strength.

In WO 95/26441, a multi-layer cardboard material is described, in which the core has a high bulk, that is a low density. This is achieved by the use of cellulose fibres, which are cross-linked with the aid of synthetic binding agents, such as modified starch, polyvinyl alcohol, polyacrylates, different acrylate copolymers, etc.

U.S. Pat. No. 5,147,505 discloses a multi-layer paper, in which coarse fibres are used for the outer plies and finer fibres are used for the core. According to this patent, the finer fibres of the core influence the paper rendering it a good smoothness.

From DE 2,360,295 a high absorption offset-cardboard is known, whose core consists of groundwood pulp and cold water soluble starch.

U.S. Pat. No. 4,913,773 describes a multi-ply paperboard, which is distinguished by great rigidity in relation to grammage. This is achieved by using special fibres in the core that are kinked and curled.

THE INVENTION

The object of the present invention is to provide a cardboard having a unique combination of rigidity, grammage and z-strength. This is achieved by providing the cardboard with a core, which has a low density and which constitutes a main part of the cardboard, as well as by providing the cardboard with thin outer plies with a high tensile stiffness index. The cardboard according to the invention is particularly suitable as packing material, such as beverage cartons.

More specifically, the invention provides a cardboard with great rigidity, which cardboard consists of a core surrounded by at least one outer ply on each side, characterised in that the cardboard has a grammage of 100–300 g/m$^2$, a bending resistance index of at least 25 Nm$^6$/kg$^3$ and a Scott Bond z-strength of at least 100 J/m$^2$, that the core mainly consists of chemi-thermomechanical pulp, has a density of 200–450 kg/m$^3$, and constitutes 55–80% of the total grammage and that the outer ply on each side has a tensile stiffness index of 7.0–9.5 kNm/g and mainly consists of chemical pulp.

According to the invention a package made of the cardboard according to the invention is also provided.

Additional characteristics of the invention are apparent from the description below and the accompanying claims.

Compared to a corresponding cardboard according to prior art, the present invention provides a cardboard having substantially greater rigidity. In terms of bending resistance index, the cardboard according to the invention usually has at least 50% greater rigidity and often more than twice as great rigidity. Furthermore, the grammage is much lower than that of a corresponding, traditional cardboard and approximately at least about 30% lower. Thus, a traditional cardboard intended for portion packaging of beverages usually has a grammage of about 180 g/m$^2$, whereas a corresponding cardboard according to the invention can be manufactured with a grammage of about 115 g/m$^2$. Correspondingly, a traditional cardboard intended for 2-litre beverage cartons usually has a grammage of about 360 g/m$^2$, whereas a corresponding cardboard according to the invention can be manufactured with a grammage of about 250 g/m$^2$. The use of the cardboard according to the invention results in a saving of material compared to the use of a traditional cardboard, which implies that the cardboard according to the invention presents a considerable economic advantage. In addition to this, the core of the cardboard according to the invention preferably mainly consists of low-refined chemi-thermomechanical pulp (CTMP), which when manufactured requires in the range of about 30–40% less energy than the corresponding, more high-refined CTMP for traditional cardboard. This saving of energy also constitutes a considerable advantage of the invention.

It should be emphasised that the invention attains the above mentioned advantages at the same time as the other qualities of the cardboard, in particular its Scott Bond z-strength, are at a satisfactory level of at least 100 J/m$^2$. Besides the z-strength, the ISO brigthness of the cardboard can also be mentioned, which preferably is at least about 72%, and its Bend-Lsen roughness, which preferably is about 2000 ml/min at the most.

DETAILED DESCRIPTION OF THE INVENTION

As stated above, the cardboard according to the invention has a grammage of 100–300 g/m$^2$, and preferably the grammage of the cardboard is 120–220 g/m$^2$.

The bending resistance index of the cardboard is at least 30 Nm$^6$/kg$^3$, preferably 30–60 Nm$^6$/kg$^3$, more preferably 35–50 Nm$^6$/kg$^3$, and most preferably 40–45 Nm$^6$/kg$^3$.

The z-strength of the cardboard is at least 100 J/m$^2$, preferably 100–180 J/m$^2$, more preferably 100–140 J/m$^2$, and most preferably 110–120 J/m$^2$.

The core of the cardboard according to the invention can consist of one or several layers of the same or different composition, the core preferably consisting of 1–3 layers.

The core should have a density of 200–450 kg/m$^3$, such as 320–450 kg/m$^3$, suitably 350–400 kg/m$^3$. Preferably, the core has, however, a density of 200–400 kg/m$^3$, and more preferably of 250–450 kg/m$^3$. Further, the core should constitute 55–80%, preferably 65–80% of the total grammage of the cardboard, that is the core constitutes the main part of the total mass of the cardboard, and the core has a low density, which results in a core having a high bulk.

Even if other materials are not excluded, the core of the inventive cardboard mainly consists, that is at least about 50% thereof consists of chemi-thermomechanical pulp (CTMP). It is specifically preferred that about 50–90% of the core consists of CTMP. This CTMP preferably has a density of 200–300 kg/m$^3$, more preferably 250–300 kg/m$^3$, and most preferably 270–290 kg/m$^3$. This density, as well as other densities stated herein, are determined according to STFI, that is the roughness has been taken into account.

In order to bind the core and improve the z-strength when using CTMP according to that stated above, it is preferred in this invention to add broke from the cardboard and/or chemical pulp to the CTMP. The broke should have a drainage resistance of 25–70° SR, whereas the chemical pulp should have a drainage resistance of 50–80° SR. The quantity of broke is preferably 10–40% by weight, based on the core, whereas the chemical pulp is added in a quantity of 0–10% by weight, based on the core. Chemical pulp here means pulp, in which the fibres have been released in a chemical way, usually by pulping. The pulp can consist of softwood pulp, hardwood pulp or mixtures thereof. The pulp can also consist of sulphite pulp or, preferably, of sulphate pulp. Both the chemical mass and the CTMP are preferably bleached.

To further improve the z-strength, it is also preferable to add cationic starch when manufacturing the core. The quantity of cationic starch is then 0.2–1.5% by weight, and preferably 0.8–1.2% by weight, based on the core. Preferably, the degree of cationisation of the starch is 0.35–0.40.

The outer plies which surround the core on both sides can, just as the core, consist of one or more layers and have the same or a different composition, but preferably the core is surrounded by one outer ply on each side. In this connection, the outer ply on one side of the core can be identical to or different from the outer ply on the other side of the core. If, for instance, it is desirable to improve the drainage, the forming and the runnability, the outer ply against the wire can have a lower degree of beating, that is a better drainage capacity, than the other outer ply.

As stated above, the outer ply should have a tensile stiffness index of 7.0–9.5 kNm/g. Preferably, the outer ply has a tensile stiffness index of 7.5–9.0 kNm/g, and most preferably of 7.5–8.5 kNm/g. The tensile stiffness of the outer ply is important to obtain the desired rigidity in the finished cardboard. The tensile stiffness index is determined for the original mass of the outer ply, that is not on the outer ply of the finished cardboard. If the tensile stiffness index is determined on the outer ply of the finished cardboard, a value which is about 15–20% lower is obtained due to the transversal shrinkage of the finished cardboard.

The outer ply is made of chemical pulp, which can consist of one kind of chemical pulp or a mixture of different kinds of chemical pulp. The chemical pulp can be selected among sulphate pulp and sulphite pulp, which in turn can be selected among softwood pulp and hardwood pulp. Preferably, the chemical pulp is bleached, the bleaching of the pulp of the outer ply and the pulp of the core being such that together they render the cardboard an ISO brightness of preferably at least 72%. The pulp of the outer ply should also have a drainage resistance of 20–35° SR, preferably of 25–30° SR. The grammage of the outer ply varies with the parameters previously stated for the cardboard and the core, but it normally amounts to about 25–30 g/m$^2$ for a cardboard having a grammage of about 100–150 g/m$^2$.

To increase the resistance of the cardboard against the influence of moisture and other liquids, which is of interest when using it as liquid packing material, the cardboard is suitably provided with a plastic coating, e.g. by extrusion coating of polyethylene, on the outside of each outer ply. In order to further improve the liquid resistance, the cardboard can be laminated with metal foil, e.g. aluminium foil. Preferably, this lamination is made in such a way that the metal foil is arranged on the inside of the cardboard, that is on the side facing the liquid.

In order to further illustrate the invention and facilitate the understanding thereof, a few illustrative, but non-restrictive examples are given below together with a comparative example. The quality parameters stated above and below are determined as follows:

- Bending resistance index: determined according to SCAN-P 29:95
- z-strength: determined according to Scott Bond, TAPPI UM403 (1991)
- Density: determined according to SCAN-proposal SCAN P 141 X
- Tensile stiffness index: determined according to SCAN-P 67
- Drainage resistance: determined according to SCAN-C 19
- ISO brightness: determined according to ISO 2470
- Roughness: determined according to Bendtsen, ISO 8791/2

The cardboard in the following examples was manufactured in a Fourdrinier paper machine. The machine had a multi-layer head box for three layers and the wire section was succeeded by a press section with a single-felted wet press, followed by a traditional drying section consisting of several drying cylinders. When manufacturing the cardboard, the pressure of the wet press was maintained at a low level (less than 80 bar) to avoid shearing of the core of the cardboard with an ensuing reduction of the z-strength.

The composition and the qualities of the different cardboards which were manufactured are indicated in the Examples below. In this connection, the different pulps constituting the cardboard layers also contain size, starch and retention agents of prior-art kind and quantities.

Examples 1–9

A three-layer cardboard was manufactured having a core, which was surrounded by an outer ply on each side. The core consisted of 70–80% by weight bleached CTMP, 20–25% by weight broke with a beating degree of 65° SR, and 0–10% by weight bleached softwood sulphate pulp with a beating degree of 75° SR. In Examples 1 and 2, the outer plies, which were identical, consisted of a mixture of 70% by weight softwood sulphate pulp "STORA 32" and 30% by weight birch sulphate pulp "STORA 61", which had been beaten together to a beating degree of 25–27° SR, whereas the outer plies in Examples 3–9 consisted of a mixture of 70% by weight bleached softwood sulphate pulp and 30% by weight birch sulphate pulp, which had been beaten together to a beating degree of 25–27° SR. The detailed composition of the core is indicated in Table 1.

The qualities of the manufactured cardboard were determined according to that stated above for the different Examples and the values are stated in Table 2.

Comparative Example

As a comparison, a three-layer cardboard was manufactured, whose core consisted of 50% by weight un-bleached CTMP, 10% by weight unbleached softwood sulphate pulp with a beating degree of 80° SR, 20% by weight un-bleached softwood sulphate pulp with a beating degree of 25° SR, and 20% by weight broke with a beating degree of 30° SR. The outer plies consisted of 40% by weight eucalyptus pulp with a beating degree of 30° SR and 60% by weight softwood sulphate pulp with a beating degree of 25° SR.

The comparative cardboard was manufactured in the way stated above and the qualities of the finished cardboard were determined according to that stated above. The values of the different qualities are indicated in Table 2.

It is apparent from Table 2 that the cardboard according to the invention (Examples 1–9) has a much higher bending resistance index than the cardboard according to the comparative Example. it is true that the z-strength of the cardboards according to the invention is somewhat lower than that of the cardboard according to the comparative Example, but it is still satisfactory.

The inventive cardboard above was extrusion coated on each side with polyethylene for the forming of a material for liquid cartons. Liquid cartons were made of this material. In that connection, there were no problems of delamination of the cardboard, that is the z-strength of the cardboard was satisfactory.

TABLE 1

| | Composition of Core | | |
|---|---|---|---|
| Example | CTMP (% by weight) | Broke (% by weight) | Bleached softwood sulphate pulp (% by weight) |
| 1 | 75 | 25 | 0 |
| 2 | 75 | 25 | 0 |
| 3 | 75 | 20 | 5 |
| 4 | 75 | 20 | 5 |
| 5 | 75 | 20 | 5 |
| 6 | 75 | 20 | 5 |
| 7 | 70 | 20 | 10 |
| 8 | 78 | 22 | 0 |
| 9 | 78 | 22 | 0 |

TABLE 2

| Quality | Ex. 1 | Ex. 2 | Ex. 3 | Ex. 4 | Ex. 5 | Ex. 6 | Ex. 7 | Ex. 8 | Ex. 9 | Comparative Example |
|---|---|---|---|---|---|---|---|---|---|---|
| Bending resistance index, $Nm^6/kg^3$ | 46.3 | 44.4 | 39 | 46.5 | 43.1 | 40.7 | 29.7 | 52.2 | 54.3 | 17.8 |
| Grammage, $g/m^2$ | 136.8 | 128.1 | 152.7 | 140.2 | 122.2 | 128 | 125.5 | 132.4 | 131.7 | 191.1 |
| z-strength, $J/m^2$ | 123 | 129 | 145 | 141 | 128 | 136 | 182 | 112 | 108 | 214 |
| Density of the core, $kg/m^3$ | 262 | 251 | 292 | 286 | 264 | 295 | 328 | 265 | 272 | 416 |
| Tensile stiffness index of outer ply, kNm/g | 8.0 | 8.0 | 8.3 | 8.3 | 8.3 | 8.3 | 8.3 | 8.3 | 8.3 | 8.3 |
| Roughness, ml/min | | | | | | | | | | |
| side 1 | 2220 | 2264 | 2166 | 2445 | 1746 | 2514 | 2485 | 2277 | 2499 | 2311 |
| side 2 | 2753 | 2776 | 3251 | 2705 | 2629 | 2590 | 2459 | 2677 | 2432 | 2601 |
| ISO brightness, % | | | | | | | | | | |
| side 1 | 73.2 | 72 | 73.7 | 72.6 | 72.2 | 72 | 72.4 | 72.5 | 72.5 | 70.8 |
| side 2 | 72.7 | 72.3 | 73.5 | 73.3 | 72.6 | 72.9 | 73.5 | 72.9 | 73.1 | 65.8 |
| Thickness SCAN, μm | 417 | 405 | 450 | 400 | 345 | 356 | 329 | 377 | 387 | 366 |
| Thickness STFI, μm | 370 | 352 | 397 | 360 | 316 | 310 | 280 | 352 | 344 | 342 |

What is claimed is:

1. A cardboard with great rigidity, which cardboard consists of a core, which is surrounded by at least one outer ply on each side, wherein the cardboard has a grammage of 100–300 $g/m^2$, a bending resistance index of at least 25 $Nm^6/kg^3$ and a Scott Bond z-strength of at least 100 $J/m^2$, the core comprises chemi-thermomechanical pulp, has a density of 200–450 $kg/m^3$, and constitutes 55–80% of the total grammage, and the outer ply on each side has a tensile stiffness index of 7.0–9.5 kNm/g and comprises chemical pulp.

2. A cardboard according to claim 1, which has a bending resistance index of 30–60 $Nm^6/kg^3$.

3. A cardboard according to claim 1, wherein the core consists of 1–3 layers, and the core is surrounded by an outer ply on each side.

4. A cardboard according to claim 1, wherein each outer ply is provided with a polymer layer on its outside.

5. A cardboard according to claim 1, wherein the core includes a chemi-thermomechanical pulp with a density of 200–300 $kg/m^3$.

6. A cardboard according to claim 1, wherein the core also includes 10–40% broke from the cardboard with a drainage resistance of 25–70° SR, up to 10% chemical pulp with a drainage resistance of 50–80° SR, and 0.2–1.5% cationic starch.

7. A cardboard according to claim 1, wherein the outer plies include bleached chemical sulphate pulp of softwood or hardwood.

8. A cardboard according to any one of the preceding claims, which has an ISO brightness of at least 72%.

9. A package made of a cardboard according to claim 1.

10. A cardboard according to claim 2, wherein the core consists of 1–3 layers, and the core is surrounded by an outer ply on each side.

11. A cardboard according to claim 2, wherein each outer ply is provided with a polymer layer on its outside.

12. A cardboard according to claim 3, wherein each outer ply is provided with a polymer layer on its outside.

13. A cardboard according to claim 2, wherein the core includes a chemi-thermomechanical pulp with a density of 200–300 $kg/m^3$.

14. A cardboard according to claim 3, wherein the core includes a chemi-thermomechanical pulp with a density of 200–300 $kg/m^3$.

15. A cardboard according to claim 2, wherein the core also includes 10–40% broke from the cardboard with a drainage resistance of 25–70° SR, up to 10% chemical pulp with a drainage resistance of 50–80° SR, and 0.2–1.5% cationic starch.

16. A cardboard according to claim 3, wherein the core also includes 10–40% broke from the cardboard with a drainage resistance of 25–70° SR, up to 10% chemical pulp with a drainage resistance of 50–80° SR, and 0.2–1.5% cationic starch.

17. A cardboard according to claim 2, wherein the outer plies include bleached chemical sulphate pulp of softwood or hardwood.

18. A cardboard according to claim 3, wherein the outer plies include bleached chemical sulphate pulp of softwood or hardwood.

19. A cardboard according to claim 2, which has an ISO brightness of at least 72%.

20. A package made of a cardboard according to claim 2.

* * * * *